US006483243B1

(12) United States Patent
Kuntzmann et al.

(10) Patent No.: US 6,483,243 B1
(45) Date of Patent: Nov. 19, 2002

(54) MULTIBAND TRAVELLING WAVE TUBE OF REDUCED LENGTH CAPABLE OF HIGH POWER FUNCTIONING

(75) Inventors: Jean-Claude Kuntzmann, Boulogne Billancourt (FR); Dominique Henry, Elancourt (FR)

(73) Assignee: Thomson Tubes Electroniques, Meudon la Foret (FR)

( * ) Notice: Subject to any disclaimer, the term of this patent is extended or adjusted under 35 U.S.C. 154(b) by 0 days.

(21) Appl. No.: 09/869,125

(22) PCT Filed: Dec. 17, 1999

(86) PCT No.: PCT/FR99/03190

§ 371 (c)(1),
(2), (4) Date: Jun. 25, 2001

(87) PCT Pub. No.: WO00/39832

PCT Pub. Date: Jul. 6, 2000

(30) Foreign Application Priority Data

Dec. 23, 1998 (FR) ..... 98 16358

(51) Int. Cl.[7] ..... H01J 25/34

(52) U.S. Cl. ..... 315/3.5; 315/39.3; 219/716; 455/3

(58) Field of Search ..... 315/3, 3.5, 3.6, 315/39.3, 393; 219/716, 717, 719; 455/3, 53, 109

(56) References Cited

U.S. PATENT DOCUMENTS

| | | | | |
|---|---|---|---|---|
| 3,612,934 A | | 10/1971 | Henry | 313/39 |
| 3,684,963 A | | 8/1972 | Henry | 455/18 |
| 3,753,030 A | | 8/1973 | McManus | 315/3.6 |
| 3,938,056 A | | 2/1976 | Pond | 330/43 |
| 4,243,914 A | | 1/1981 | Delory et al. | 315/2.5 |
| 4,475,242 A | * | 10/1984 | Rafal et al. | 455/3 |
| 4,559,474 A | | 12/1985 | Duret et al. | 315/3.6 |
| 4,572,985 A | | 2/1986 | Kuntzmann et al. | 315/3.5 |
| 4,871,950 A | | 10/1989 | Kuntzmann et al. | 315/39.5 |
| 4,970,432 A | | 11/1990 | Tikes et al. | 315/3.5 |
| 5,071,055 A | | 12/1991 | Grauleau et al. | 228/122.1 |
| 5,132,591 A | | 7/1992 | Santonja et al. | 315/3.5 |
| 5,132,592 A | | 7/1992 | Nugues et al. | 315/3.5 |
| 5,521,360 A | * | 5/1996 | Johnson et al. | 219/716 |

FOREIGN PATENT DOCUMENTS

| | | |
|---|---|---|
| EP | 0 401 065 | 12/1990 |
| EP | 0 500 241 | 8/1992 |
| FR | 2 454 694 | 11/1980 |
| GB | 2 050 047 | 12/1980 |

* cited by examiner

*Primary Examiner*—Don Wong
*Assistant Examiner*—Wilson Lee
(74) *Attorney, Agent, or Firm*—Oblon, Spivak, McClelland, Maier & Neustadt, P.C.

(57) ABSTRACT

A traveling wave tube designed to operate as an amplifier within plural frequency bands, which includes a microwave line through which electrons travel and in which a signal is amplified. The microwave line includes, in succession, an input section separated from a succession of gapped output sections, each output section working within one of the operating frequency bands of the traveling wave tube. The input section, connected at one end to an input for injecting the signal to be amplified, works within a frequency band encompassing the operating frequency bands of the traveling wave tube and is intended to preamplify the signal to be amplified. The succession of output sections receives the preamplified signal, each of the output sections being intended to amplify it if the signal is at a frequency lying within its working frequency band and to let it pass through virtually without any interaction if it is at a frequency outside its working frequency band. Each of the output sections is connected at an output end to an output for extracting the preamplified signal that it has amplified. Such a traveling wave tube has a short length and is capable of operating at high power.

14 Claims, 6 Drawing Sheets

MULTIBAND TRAVELLING WAVE TUBE OF REDUCED LENGTH CAPABLE OF HIGH POWER FUNCTIONING

BACKGROUND OF THE INVENTION

The present invention relates to a multiband traveling wave tube capable of operating at high power. This tube, intended especially to be used in airborne and space applications, must be relatively short.

The development of techniques and the increasing control of materials have made it possible to develop traveling wave tubes intended to operate within a very wide frequency range and which are relatively short. These tubes are known as mini-TWTs. These are travelling wave tubes with a one-piece line in the form of a tight helix. From the frequency standpoint, a ratio of the high frequency to the low frequency of the band of at least 3 is obtained.

From the dimensional standpoint, these tubes do not exceed about thirty centimeters, but from the power standpoint they barely reach more than a few tens of watts.

It would be conceivable to extrapolate these tubes in order to increase their power but, for a given gain, achieving a higher power entails increasing the helix voltage and increasing its length. However, it is not a question of reducing the gain, so as to obtain the required power without increasing the length of the helix. This approach does not lead to a multiband traveling wave tube, of short length, capable of operating at high power.

BRIEF SUMMARY OF THE INVENTION

The subject of the present invention is a multiband traveling wave tube which has a length of the order of that of a mini-TWT but which is capable of operating at higher powers, while still maintaining a gain of the same order of magnitude.

For this purpose, the multiband traveling wave tube according to the invention comprises a microwave line along which electrons travel and in which a signal is amplified. This microwave line comprises, in succession, a microwave line input section separated from a succession of gapped microwave line output sections, each output section working within one of the operating bands of the tube.

The input section is connected, at one end, to input means for injecting the signal to be amplified and works within a frequency band encompassing the operating frequency bands of the tube. It is intended to preamplify the signal to be amplified.

The succession of output sections receives the preamplified signal, each of its output sections being intended to amplify it if it is at a frequency lying within its working frequency band and to let it through virtually without any interaction if it is at a frequency outside its working frequency band, each of the output sections being connected at one end to output means for extracting the preamplified signal that it has amplified.

Preferably, the central frequencies of the working bands of the output sections decrease with their distance from the input section.

With regard to the power of the signal amplified by an output section, this increases the further the output section is from the input section.

The microwave line sections are in the form of a helix, each helix being held in place in a sheath by dielectric supports and the various sheaths being joined together.

To be able to work in a very wide band, the input section includes dispersion-correcting means, such as gates.

Preferably, the helix of the first output section will have substantially the same length and/or the same internal diameter as the helix of the input section.

The helical wire of the first output section will also preferably have the same cross section as that of the helical wire of the input section.

To maintain, in the first output section, the synchronism, acquired in the input section, between the velocity of the electron beam and the velocity of the signal, the pitch of the helix of the first output section will preferably be smaller than that of the helix of the input section.

Preferably, the length and/or the pitch and/or the internal diameter of the helices of the output sections will increase as they get further from the input section. The same applies to the cross section of the helical wire.

To avoid the appearance of self-oscillation phenomena, the input section is provided with an attenuation region at the opposite end to that connected to the means for injecting the signal to be amplified.

For this purpose, each output section is provided with an attenuation region at the opposite end to that connected to the means for extracting the signal that it has amplified.

BRIEF DESCRIPTION OF THE DRAWINGS

Further features and advantages of the invention will become apparent on reading the description which follows of illustrative examples of tubes according to the invention, the description being illustrated by the figures which show.

In these figures, the scales have not necessarily been respected for the sake of clarity.

DETAILED DESCRIPTION OF THE INVENTION

Figure 1:
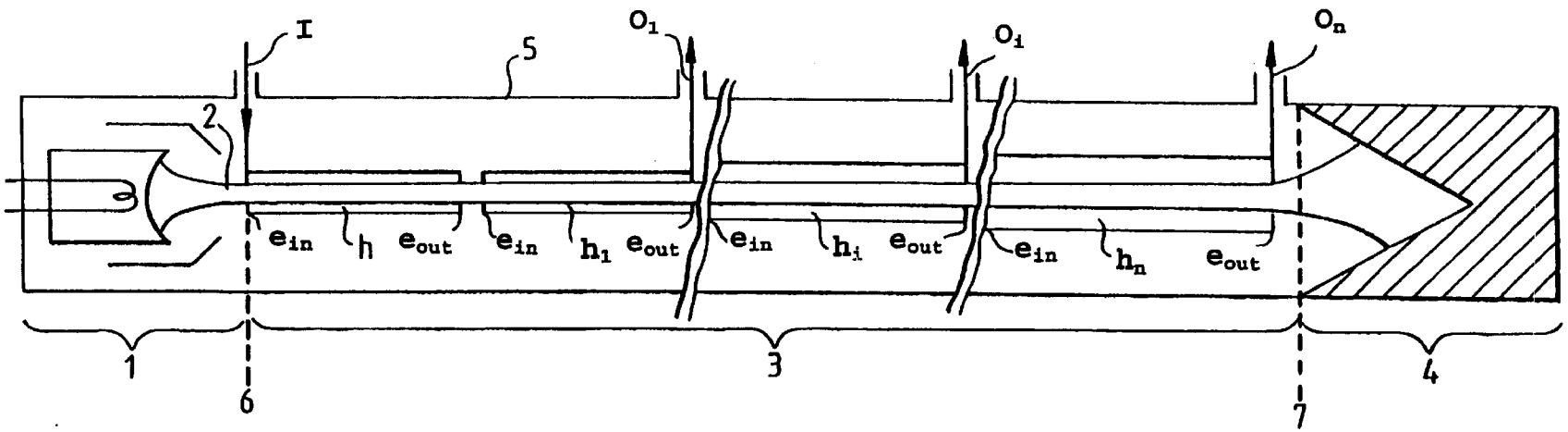
FIG. 1, a schematic longitudinal section through a traveling wave tube according to the invention.

FIG. 1 shows schematically a multiband traveling wave tube according to the invention.

Conventionally, it comprises, in succession in a casing 5, a gun 1 for producing an electron beam 2, a body 3 in which the electron beam 2 interacts with a signal to be amplified, and a collector 4 for collecting the electrons of the beam 2 as they leave the body 3.

According to the invention, the electron beam 2 passes, between the input 6 and the output 7 of the body 3, through a microwave line 8 formed from several gapped microwave line sections h, $h_1 \ldots, h_i, \ldots h_n$ placed one after another. Among these sections, the first section through which the beam 2 passes is a section h called the input section, other sections $h_1 \ldots h_i \ldots h_n$ form a succession of sections called output sections and their number n is equal to the number of frequency bands $B_1 \ldots B_i \ldots B_n$ within which the tube is intended to operate, n being an integer greater than or equal to 2. Each of the output sections $h_1 \ldots h_i \ldots h_n$ is intended to work in one of the operating bands of the tube $B_1 \ldots B_i \ldots B_n$, respectively. Each frequency band $B_1 \ldots B_i \ldots B_n$ is centered on a central frequency $F_1 \ldots F_i \ldots F_n$, respectively. Each frequency band is associated with one output section.

The electron beam 2 enters each section h, $h_1 \ldots h_i \ldots h_n$ via an input end $e_{in}$ and leaves from it via an output end $e_{out}$.

The input section h is intended to operate as a preamplifier within a very wide band B encompassing all the operating bands $B_1 \ldots B_i \ldots B_n$ of the tube. The input end $e_{in}$ of the input section h is connected to means I for injecting a signal to be amplified in the tube. Its output end $e_{out}$ is near the input end $e_{in}$ of the first output section $h_1$.

The central frequencies $F_1 \ldots F_i \ldots F_n$ of the working bands $B_1 \ldots B_i \ldots B_n$ of the output sections $h_1 \ldots h_i \ldots h_n$ decrease with their distance from the input section h. Thus, $F_1 > F_i > F_n$.

Each output section $h_1 \ldots h_i \ldots h_n$ in the succession is intended to amplify the signal preamplified in the input section h if the preamplified signal is at a frequency lying within its working frequency band $B_1 \ldots B_i \ldots B_n$. The output sections $h_1 \ldots h_i \ldots h_n$ have virtually no action on the preamplified signal which travels through them and which is not at a frequency lying within their working frequency band.

Each of the output ends $e_{out}$ of the output sections $h_1 \ldots h_i \ldots h_n$ is connected to output means $O_1 \ldots O_i \ldots O_n$ for extracting the preamplified signal passing through it if the latter has been amplified in said output section $h_1 \ldots h_i \ldots h_n$.

The signal to be amplified, injected at the input end $e_{in}$ of the input section h, travels through it, is preamplified therein and then enters the first output section $h_1$. The preamplified signal which passes through the first output section $h_1$ is amplified therein if its frequency lies within the band $B_1$ and it is then extracted by the output means $O_1$. If the frequency of the preamplified signal is not within the band $B_1$, the preamplified signal travels through the first output section $h_1$ virtually without any coupling with the electron beam 2 and, on leaving the output end $e_{out}$ of the first output section $h_1$, it enters the second output section $h_2$ where it is amplified if its frequency is within the band $B_2$ and then extracted. If its frequency is not within the band $B_2$, it enters the third output section $h_3$ and so on, from section to section, until it is amplified in the appropriate section and then extracted.

Assuming that a signal of frequency F propagates in the output section $h_i$ (i being an integer between 1 and n−2), if it is not amplified therein this means that the frequency F is not included within the band $B_i$. The signal of frequency F is not extracted at the output end of the output section $h_i$ and it then enters the next output section $h_{i+1}$. If its frequency F is within the frequency band $B_{i+1}$ associated with the output section $h_{i+1}$, it is amplified and then extracted at the end $e_{out}$ of said section $h_{i+1}$. If its frequency F is outside the band $B_{i+1}$, it enters the next section $h_{i+2}$, and so on.

An illustrative example of a tube according to the invention will now be given in greater detail. It will be assumed that this is a two-band traveling wave tube.

Figure 2:
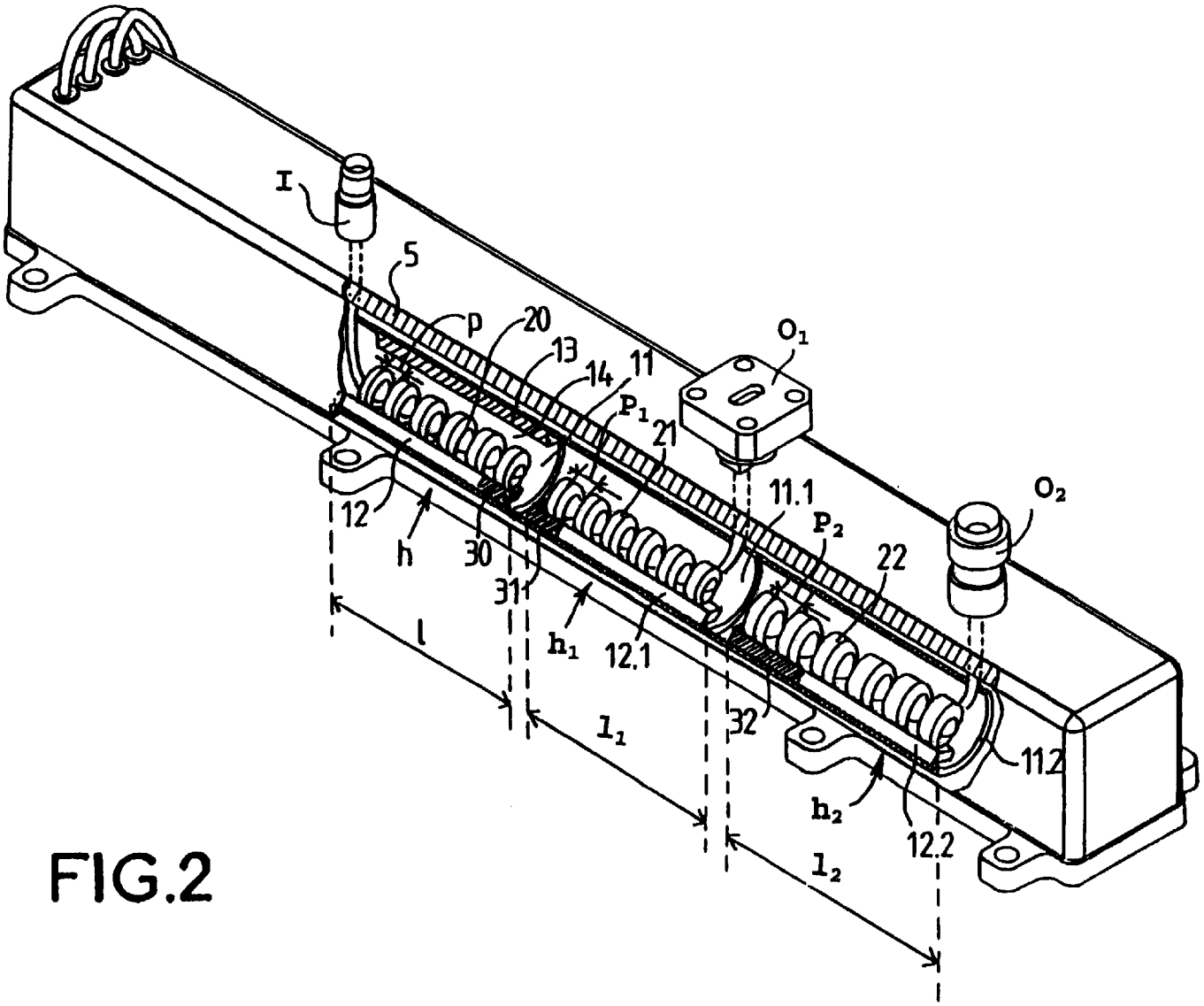
FIG. 2, an exploded schematic view of a tight-helix traveling wave tube, according to the invention.

FIG. 2 shows such a tube seen from the outside, but the casing 5 of which has been partly opened so as to show the various microwave line sections h, $h_1$, $h_2$ which are in the form of helices. The other components inside the casing, such as the gun, the focuser and the collector, have not been shown for the sake of clarity.

The helices 20, 21, 22, each inserted into a conducting sheath 11, 11.1, 11.2, are held in place in the sheath 11, 11.1, 11.2 by means of insulating supports 12, 12.1, 12.2. In the example, three insulating supports 12, 12.1, 12.2 have been provided per helix (but only one can be seen in FIG. 2) and these supports have approximately the same length as the helix 20, 21, 22 that they hold in place. Conventionally, the supports may be made, for example, of boron nitride, alumina or beryllium oxide. There is no contact between the helices 20, 21, 22. The various sheaths 11, 11.1, 11.2 are joined together. The joints are vacuum-tight.

The input end $e_{in}$ of the input section h is connected to input means I for injecting a signal to be amplified, these being shown in the form of a coaxial line.

The two output sections $h_1$, $h_2$ work within the band $B_1$, $B_2$, of respective central frequency $F_1$, $F_2$,respectively. The frequency $F_1$ is higher than the frequency $F_2$. The output end $e_{out}$ of the section $h_1$ is connected to output means $O_1$ for extracting the preamplified signal if it has been amplified by said section $h_1$. The output means $O_1$ are shown by a waveguide, this being conventional at high frequency. The output end $e_{out}$ of the section $h_2$ is connected to output means $O_2$ for extracting the signal which has been amplified by the section $h_2$. In the example, these means are a coaxial line. Of course, each of the input and output means could be of a different type. The section h is intended to work within a very wide band B encompassing the two bands $B_1$ and $B_2$.

A The characteristics of each of the line sections h, $h_1$, $h_2$ will now be explained in greater detail.

Figure 3A:
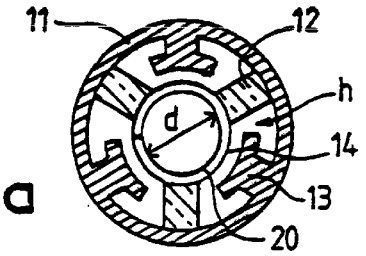
FIGS. 3*a* and 3*b*, cross sections of two embodiments of the input section.

In order for the input section h to be able to work within the very wide band B, while still keeping the normalized phase velocity of the signal that has to be preamplified approximately constant, whatever the frequency, the input section h includes dispersion-correcting means 13 such as, for example, gates. In FIG. 3*a*, the gates 13 are separate from the supports 12 and are conductors extending longitudinally along the helix 20 and projecting from the sheath 11 toward the helix 20. These gates 13 are separated from the helix 20 by a space 14. They are placed between the supports 12.

Figure 3B:
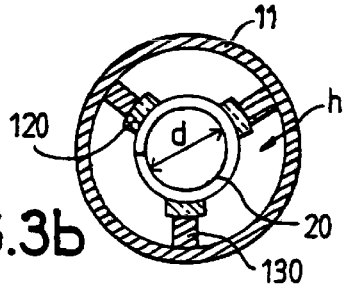

Another type of gate may be used, as illustrated in FIG. 3*b*. These gates integrated into the dielectric supports are described in European patent EP-B-0 401 065. The helix is held in place by the dielectric supports 120 which are in turn supported by conducting elements 130 projecting from the internal wall of the sheath 11 toward the helix 20. This configuration has the advantage of obstructing the inside of the sheath less, thereby reducing the time needed to pump down and qualitatively improving the vacuum.

A ratio of the lowest central frequency $F_2$ to the highest central frequency $F_1$ of between 2 and 4 may hopefully be obtained.

FIGS. 3*a* and 3*b* show cross sections through the input section h. The internal diameter d of the helix 20 is relatively small so that the section h can work as a preamplifier within the band B encompassing all the operating bands of the tube. This diameter depends on the frequency band to be amplified.

Figure 3C:
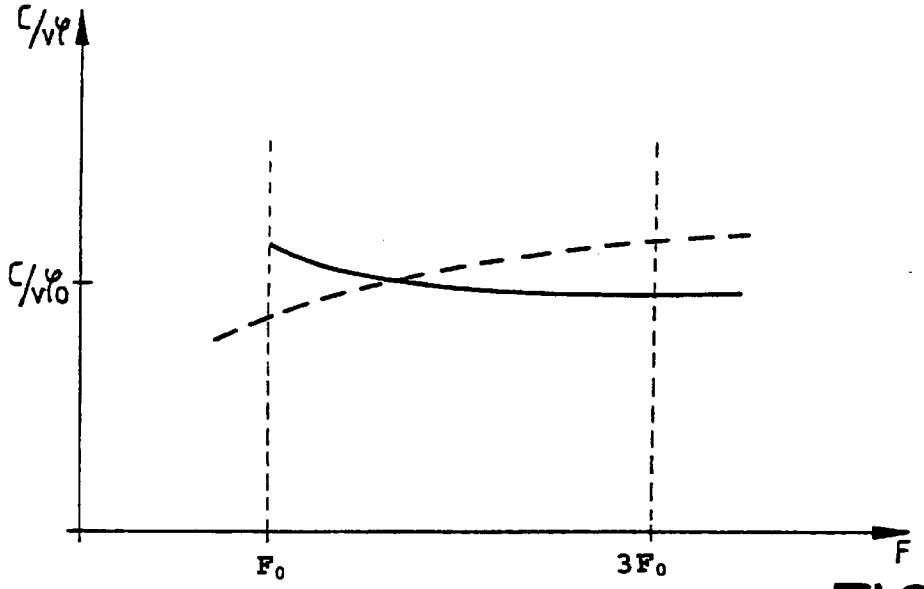
FIGS. 3*c*, 3*d*, the normalized phase velocity and the gain as a function of the frequency of the input section in FIG. 3*a*, respectively.

FIG. 3*c* is a diagram of the normalized phase velocity $c/v\phi$ of the signal propagating through the input section h as a function of the frequency F. It is assumed in the example described that the tube is intended to operate within two bands $B_1$, $B_2$ centered around the frequency $F_0$ and the frequency $3F_0$, respectively. The normalized phase velocity $c/v\phi$ is the ratio of the phase velocity $v\phi$ to the velocity of light c. The solid curve is obtained in the input section h with gates 13 separate from the supports 12 and the dotted curve is that obtained without the gates 13.

Figure 3D:
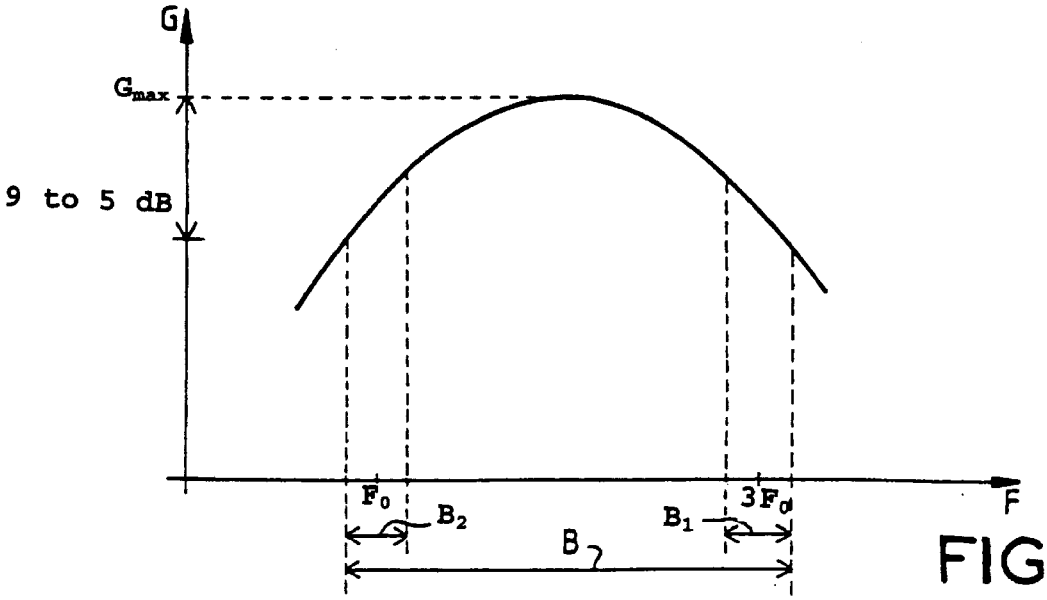

FIG. 3*d* shows the gain G of the input section h as a function of the frequency F. The maximum gain $G_{max}$ is obtained in the middle part of the curve, that is to say for a mid-frequency, the frequencies $F_0$ and $3F_0$ lying on each side of the mid-frequency. In the operating bands $B_1$, $B_2$, the gain is approximately 4 to 5 dB below the maximum gain.

The first output section $h_1$ is that which works as an amplifier at the highest frequency, in this case $3F_0$. Its operating band $B_1$ is narrower than the band B and the section $h_1$ does not require dispersion-correcting means.

Figure 4A:
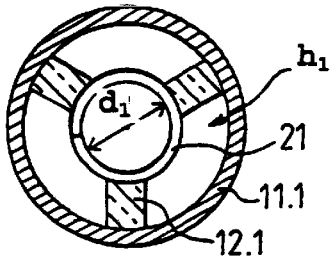
FIG. 4*a*, a cross section of the first output section.

FIG. 4*a* shows, in cross section, the first output section $h_1$ with the dielectric supports 12.1. To simplify matters, its helix 21 may be made with the same wire as the helix 20 of the input section h if the desired power at the output end $e_{out}$ of the first output section is not too high. This will have approximately the same internal diameter $d_1$ as that d of the helix 20 of the input section h since this first output section $h_1$ is associated with the band $B_1$ whose central frequency $3F_0$ is the highest.

However, its pitch $p_1$ may be smaller than that p of the helix 20 of the input section h in order to maintain the synchronism between the velocity of the electron beam and the velocity of the signal traveling through the helix, this synchronism being acquired in the input section h.

The length $l_1$ of the helix 21 is related to the gain needed to obtain the desired power at the frequency $3F_0$. It is desirable for the gain of the first output section $h_1$ to be greater than that of the input section h. However, the length $l_1$ of the helix of the first output section $h_1$ may be of the same order as that of the helix 20 of the input section h, since the gain per unit length of a helical line without any dispersion-correcting means is greater than that of a helical line with dispersion-correcting means.

An output power of the order of a hundred watts might be expected to be achieved for a frequency of several tens of gigahertz.

Figure 4B:
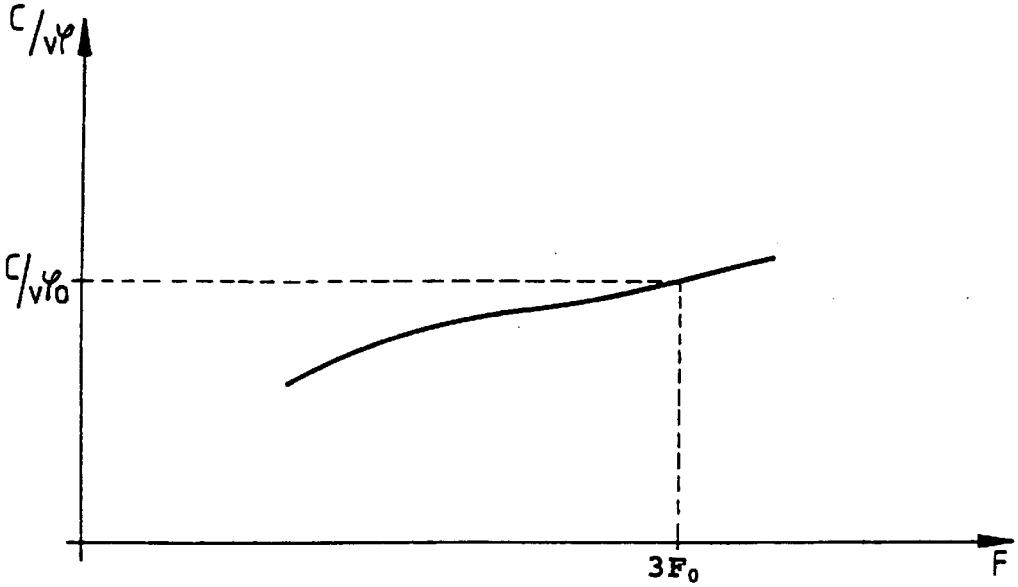
FIGS. 4*b*, 4*c*, the normalized phase velocity and the gain as a function of the frequency of the first output section in FIG. 4*a*, respectively.
Figure 4C:
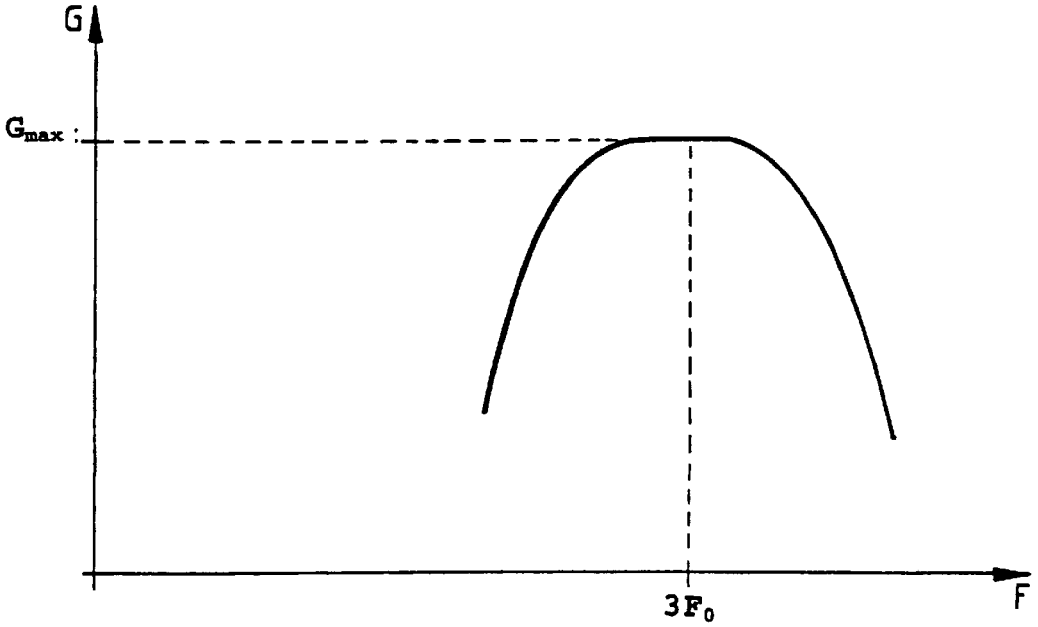

FIG. 4*b* is a curve of the normalized phase output as a function of the frequency for this first output section $h_1$, while FIG. 4*c* is a curve of the gain as a function of the frequency. The gain is a maximum for the central frequency $3F_0$.

Figure 5A:
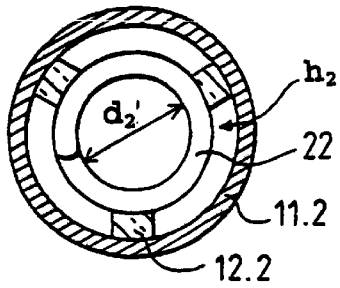
FIG. 5*a*, a cross section of the last output section.

FIG. 5*a* shows a cross section through the next output section $h_2$, which here is the last. It is associated with the band $B_2$ having the lowest central frequency $F_0$.

This second output section $h_2$ does not require dispersion-correcting means either, since the band $B_2$ is narrower than the band B. The same would apply for all the other output sections.

The internal diameter $d_2$ of its helix 22 is greater than that of the helix 21 of the output section $h_1$ which precedes it. The internal diameter of the helix varies in an approximately inversely proportional manner with the operating frequency so that the amplification parameter remains constant. The ratio of the two diameters $d_1$, $d_2$ is approximately the same as that of the corresponding central frequencies $3F_0$, $F_0$. More generally, the internal diameter of the helices of the output sections $h_1$, $h_2$ increases with their distance from the input section h. With such a configuration, the electron beam diameter increases further on approaching the collector. As a consequence, the beam is focused in a conventional manner for a person skilled in the art.

The supports 12.2 which hold the helix 22 in place are matched to the diameter of the helix and to that of the sheath section 11.2. It is possible for the various sheath sections 11, 11.1, 11.2 not to have the same diameter.

The pitch $P_2$ of the helix 22 of the second output section $h_2$ is greater than that $P_1$ of the output section $h_1$ which precedes it, again for the purpose of maintaining the synchronism between the velocity of the electron beam and the velocity of the signal which travels through the helix 22. More generally, the pitch of the helices of the output sections increases with their distance from the input section.

It will be assumed that the signal produced by the output section $h_2$ has a higher power than that of the signal produced by the output section $h_1$ which precedes it, which means that the wire of the helix 22 has to have a larger cross section than that of the wire of the helix 21. It is possible to achieve, at the output end of the output section $h_2$, powers three to four times greater than those obtained at the output end of the output section $h_1$. Generalizing, the cross section of the wire of the helices of the output sections will increase with their distance from the input section.

The length $l_2$ of the helix 22 is tied to the gain needed to obtain the desired power at the frequency $F_0$. The section $h_2$ will have a length $l_2$ greater than that $l_1$ of the output section $h_1$ which precedes it since the frequency at which it works is lower. More generally, within the succession the length of the helices of the output sections increases with their distance from the input section.

With a length $l_2$ greater than the length 1 by a few centimeters, an output power of several hundreds of watts might be expected for a frequency of the order of ten gigahertz.

Figure 5B:
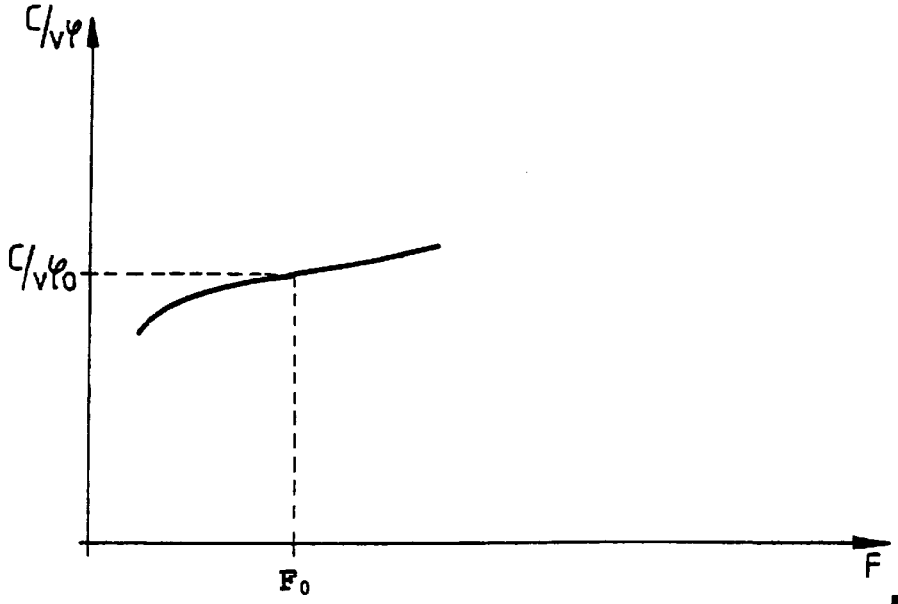
FIGS. 5*b*, 5*c*, the normalized phase velocity and the gain as a function of the frequency of the last output section in FIG. 5*a*, respectively.
Figure 5C:
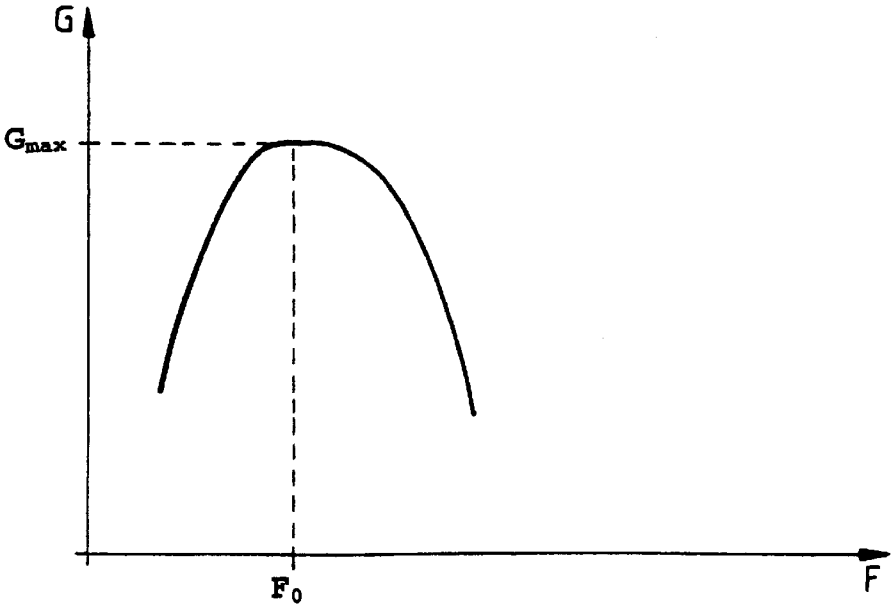

FIG. 5*b* is a curve of the normalized phase velocity as a function of the frequency for this second output section $h_2$, while FIG. 5*c* is a curve of its gain as a function of the frequency. The gain is a maximum for the central frequency $F_0$.

Conventionally, in order to avoid self-oscillation phenomena in the tube, an attenuation region 30, 31, 32 is provided in the microwave line sections h, $h_1$, $h_2$. More specifically, these attenuation regions cover the supports 12, 12.1, 12.2 for the helices 20, 21, 22 and they may be produced by depositing carbon, for example. These attenuation regions are respectively located with the first 30 near the output $e_{out}$ of the input section h and the others 31, 32 near the input end $e_{in}$ of the respective output sections $h_1$, $h_2$. The attenuation region 31 of the first output section $h_1$ has approximately the same length as that of the input section h. On the other hand, the attenuation region 32 of another output section $h_2$ is longer than that 31 of the output section $h_1$, which precedes it.

Figure 6:
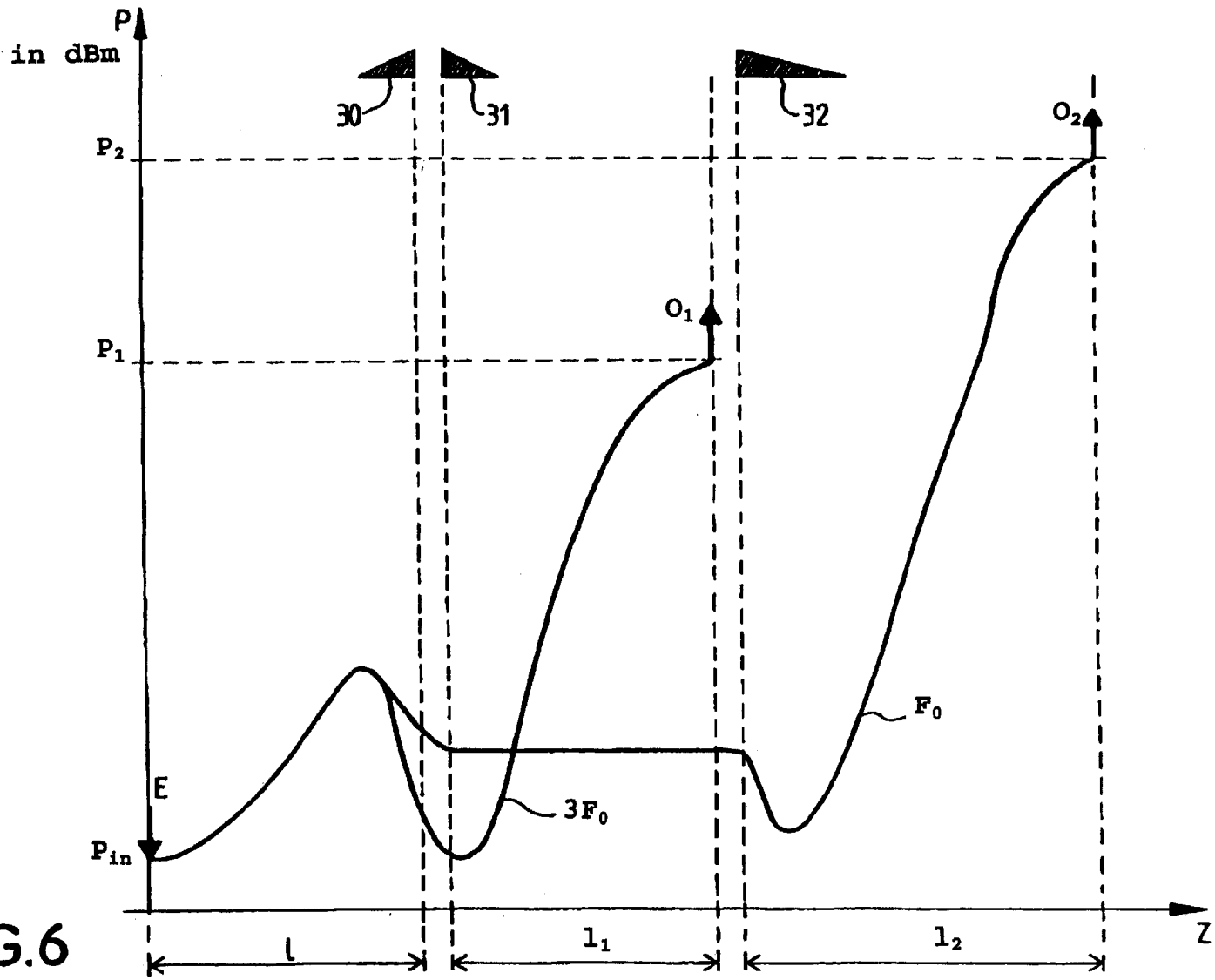
FIG. 6, a plot showing the power of a signal, injected into the tube of FIG. 2 and traveling along the microwave line, as a function of its frequency.

FIG. 6 is a curve of the power P (expressed in dBm) of a signal which is injected with an amplitude $P_{in}$ into the tube of FIG. 2 and which travels along the microwave line until it is extracted, either at the output means $O_1$ or at the output means $O_2$.

The signal extracted at the output means $O_1$ has a power of amplitude $P_1$ and is at the frequency $3F_0$. The signal extracted at the output means $O_2$ has a power $P_2$ and is at a frequency $F_0$. The amplitude $P_2$ is approximately three times greater than the amplitude $P_1$.

It should be noted that the powers drop rapidly at the attenuation regions 30, 31, 32, which are shown symbolically by triangles. In each output section, the signal amplified therein has an amplitude which increases strongly as soon as it propagates beyond the corresponding attenuation region 31, 32.

What is claimed is:

1. A traveling wave tube capable of operating as an amplifier in plural frequency bands, comprising a microwave line along which electrons travel and in which a signal is amplified, wherein the microwave line comprises, in succession, a microwave line input section separated from a succession of gapped microwave line output sections, each output section having a respective working band corresponding to one of the plural frequency bands of the traveling wave tube, in which band it behaves as an amplifier, wherein;

the microwave line input section is connected at one end to input means for injecting the signal to be amplified and having a working frequency band encompassing the plural frequency bands of the traveling wave tube, in order to preamplify the signal to be amplified, and the succession of output sections receive the preamplified signal and are configured to let the frequencies lying outside its respective working band pass, virtually without any action, to a following section, each of the output sections being connected by an output end to output means for extracting the amplified signal.

2. The traveling wave tube as claimed in claim 1, wherein the output sections are placed in an order corresponding to the working frequency bands, sections furthest from the input section having a central frequency of their operating band which is lower than closest sections.

3. The traveling wave tube as claimed in claim 1, wherein the output sections are placed in an order corresponding to their power gain, sections having a highest gain being furthest from the input section.

4. The traveling wave tube as claimed in claim 1, wherein the input section and output sections are in the form of helices, each helix being held in place in a conducting sheath by dielectric supports, the sheaths being joined together.

5. The traveling wave tube as claimed in claim 4, wherein the input section includes dispersion-correcting means.

6. The traveling wave tube as claimed in claim 5, wherein the dispersion-correcting means comprise gates.

7. The traveling wave tube as claimed in claim 4, wherein at least one of a length and internal diameter of the helix of a first output section is substantially the same as those of the helix of the input section.

8. The traveling wave tube as claimed in claim 4, wherein a pitch of the helix of a first output section is smaller than a pitch of the helix of the input section.

9. The traveling wave tube as claimed in claim 4, wherein a cross-section of the helix of a first output section is substantially the same as that of the helix of the input section.

10. The traveling wave tube as claimed in claim 4, wherein at least one of a length and pitch of the helices of the output sections increase with their distance from the input section.

11. The traveling wave tube as claimed in claim 4, wherein an internal diameter of the helices of the output sections increases with their distance from the input section.

12. The traveling wave tube as claimed in claim 4, wherein a cross-section of the helix of the output sections increases with its distance from the input section.

13. The traveling wave tube as claimed in claim 1, wherein the input section is provided with an attenuation region at an opposite end to that connected to the input means for injecting the signal to be amplified.

14. The traveling wave tube as claimed in claim 1, wherein each output section is provided with an attenuation region at an opposite end to that connected to the output means for extracting the signal that it has amplified.

* * * * *